US005165633A

United States Patent [19]

Effa et al.

[11] Patent Number: 5,165,633

[45] Date of Patent: Nov. 24, 1992

[54] COVERS

[75] Inventors: Gerald I. Effa, 33 W. Missouri, #20, Phoenix, Ariz. 85013; Werner Dillenburger, Tacoma, Wash.

[73] Assignee: Gerald I. Effa, Phoenix, Ariz.

[21] Appl. No.: 591,298

[22] Filed: Oct. 1, 1990

[51] Int. Cl.[5] ..... F16M 11/00

[52] U.S. Cl. ..... 248/164; 248/166

[58] Field of Search ..... 248/167, 164, 166; 108/90, 115, 16; 135/96, 109, 112, 115; 5/98.2; 150/165, 154, 164, 166; D6/610, 618, 612, 617

[56] References Cited

U.S. PATENT DOCUMENTS

| | | | |
|---|---|---|---|
| 925,059 | 6/1909 | Walker | 135/109 X |
| 2,468,547 | 4/1949 | Duhmert | 248/164 X |
| 2,641,001 | 6/1953 | Krasnov . | |
| 2,809,466 | 10/1957 | Glover . | |
| 2,917,094 | 12/1959 | Sullivan | 150/166 |
| 3,028,871 | 4/1962 | Clift, Jr. | 135/109 |
| 3,368,601 | 2/1968 | Gantert-Merz . | |
| 3,629,982 | 12/1971 | Ballay | 135/109 X |
| 3,738,405 | 6/1973 | Ericson | 150/154 X |
| 3,747,655 | 7/1973 | Hadtke . | |
| 3,905,414 | 9/1975 | Guebert et al. . | |
| 3,959,854 | 6/1976 | Lewis . | |
| 4,069,853 | 1/1978 | Surabian | 150/154 X |
| 4,237,958 | 12/1980 | Guebert et al. . | |
| 4,244,411 | 1/1981 | Karlström et al. . | |
| 4,580,750 | 4/1986 | Spellman | 248/164 |
| 4,796,314 | 1/1989 | Garduno | 248/164 X |
| 4,954,384 | 9/1990 | Hartwell | 150/154 X |

FOREIGN PATENT DOCUMENTS

| | | | |
|---|---|---|---|
| 1288975 | 2/1969 | Fed. Rep. of Germany | 150/154 |
| 1201167 | 12/1959 | France | 150/154 |

OTHER PUBLICATIONS

Advertising Literature, Snap-Drape, Inc. Advertising Literature dated Feb. 15, 1988, Artex International, Inc.

*Primary Examiner*—Karen J. Chotkowski
*Attorney, Agent, or Firm*—Hughes & Multer

[57] ABSTRACT

Covers for concealing tray jacks and thereby enhancing the ambiance of the settings in which those jacks are employed. These covers have a skirt which surrounds the jack and conceals its lags and a multipart upper component which conceals the top of the jack and rests on the latter, vertically positioning the cover with respect to the floor on which the jack is placed. Provision is made for detachably connecting the cover to the associated jack to facilitate the use and handling of the latter. A novel construction of the cover causes the ends of the latter to automatically fold inward and together as the jack is folded to a collapsed configuration. This faciltates the collapsing and handling of the covered tray. The covers may be fabricated from a wide variety of materials, in any desired color, and may bear logos and other designs.

6 Claims, 3 Drawing Sheets 68
125
74
22
66
30
44
88
96
86
120
80
116
76
28
38
118
72
52
132
92
84
94
56
54
130
82

COVERS

TECHNICAL FIELD OF THE INVENTION

The present invention relates to covers and, more particularly to novel, improved covers for folding service tray jacks.

BACKGROUND OF THE INVENTION

Trays are employed in restaurants, banquet rooms, and other settings to facilitate the transfer of food and beverages and dirty dishes. At the point where the food is to be served, or soiled dishes and utensils picked up, these trays are typically set down on, and supported by, tray jacks. These are stands made up of two subassemblies, each having parallel, spaced apart legs, and a separate or integral, horizontally extending crosspiece. Assembled, the two legs on each side of the stand are arrayed in a X-configuration and connected at the intersection by a screw or other pivot member. This allows the tray jack to be collapsed, making it easier to carry. Alternatively, the two tray jack subassemblies can be pivoted apart about the pivot members, spreading the legs and horizontal cross members. This provides a stable base and, with the cross members spread, a stable support for a serving or busing tray. Flexible straps, connected between the cross members of the two tray jack subassemblies, or between horizontal runs at their lower ends, limit the movement relative to each other of the two tray jack subassemblies.

Tray jacks of the character just described are fabricated from wood and from metal tubing. They tend to be aesthetically somewhat less than pleasing. Consequently, it is common to cover tray jacks after they have been set up. Heretofore, tablecloths of an appropriate size have been employed for this purpose. This, however, is not entirely satisfactory. Such covers tend to slip which results in their presenting an unsightly appearance. This also makes it difficult to keep the cover in place when it is collapsed for movement from one place to another.

SUMMARY OF THE INVENTION

I have now invented, and disclosed herein, certain new and novel covers which are designed expressly for tray jacks and are free of the disadvantages of the cloths heretofore employed to cover such jacks.

In general, these novel covers include: (a) a skirt which surrounds the jack and extends from its upper to its lower end to conceal the jack, and (b) panels at the upper end of the cover. These panels extend inwardly from the ends and sides of the skirt and are engaged by the crosspieces of the tray jack components, thereby supporting the cover from the jack.

Straps with appropriate fasteners are employed to attach the cover to the crosspieces of the tray jack subassemblies. This keeps the cover in place which is important when the tray jack is in use and when it is stored. Also, the positive attachment of the cover to the associated tray jack facilitates the collapsing and opening of the tray jack because the cover remains in place while these operations are being performed.

Another important feature of the present invention is a construction of the skirt end panels which causes the upper ends of those panels to fold inwardly on themselves when the tray jack is collapsed. This is a capability not possessed by the conventional cloth cover, and it materially facilitates the collapsing and handling of the tray jack.

Aside from the foregoing, the novel covers disclosed herein have the advantage that they can be dimensioned to fit all of the commercial tray jacks in use today in the restaurant and hospitality industries. Furthermore, my novel tray jack covers have the advantage that they can readily be fabricated to match tablecloths, napkins, and other linens in the settings in which they are used and/or to feature company logos, cartoon figures, and a host of other designs.

From the economic viewpoint, my novel covers have the advantage that, because the jack is covered, the appearance of both the metal tray jacks and wooden tray jack is enhanced. This enables the user to market its company logo or enhance customer satisfaction by applying custom designs to the cover.

OBJECTS OF THE INVENTION

From the foregoing, it will be apparent to the reader that one important and primary object of the present invention resides in the provision of covers for service tray jacks and, more particularly, in the provision of such covers which are superior in several respects to the cloths currently employed to cover such jacks.

Other, related, and also important but more specific objects of the invention reside in the provision of covers for service tray jacks:

which better cover the legs of the tray jack than do the cloths currently in use as tray jack covers;

which have an arrangement for positively attaching the cover to the associated tray jack, thereby facilitating the use, storage, and handling of the jack;

which are so constructed that the upper ends of the cover automatically fold in upon themselves when the tray jack is collapsed, thereby materially facilitating this operation;

which, because they completely cover the tray jack, make it possible to purchase materially less expensive jacks and by adding this cover provide a functional custom piece of superior appearance;

which can be so constructed as to universally fit the tray jacks in use at the present time;

which can be fabricated from a variety of materials and in different colors and, if desired, with an unlimited variety of logos and other designs.

DETAILED DESCRIPTION OF THE INVENTION

Figures 1, 4, 5, 6:
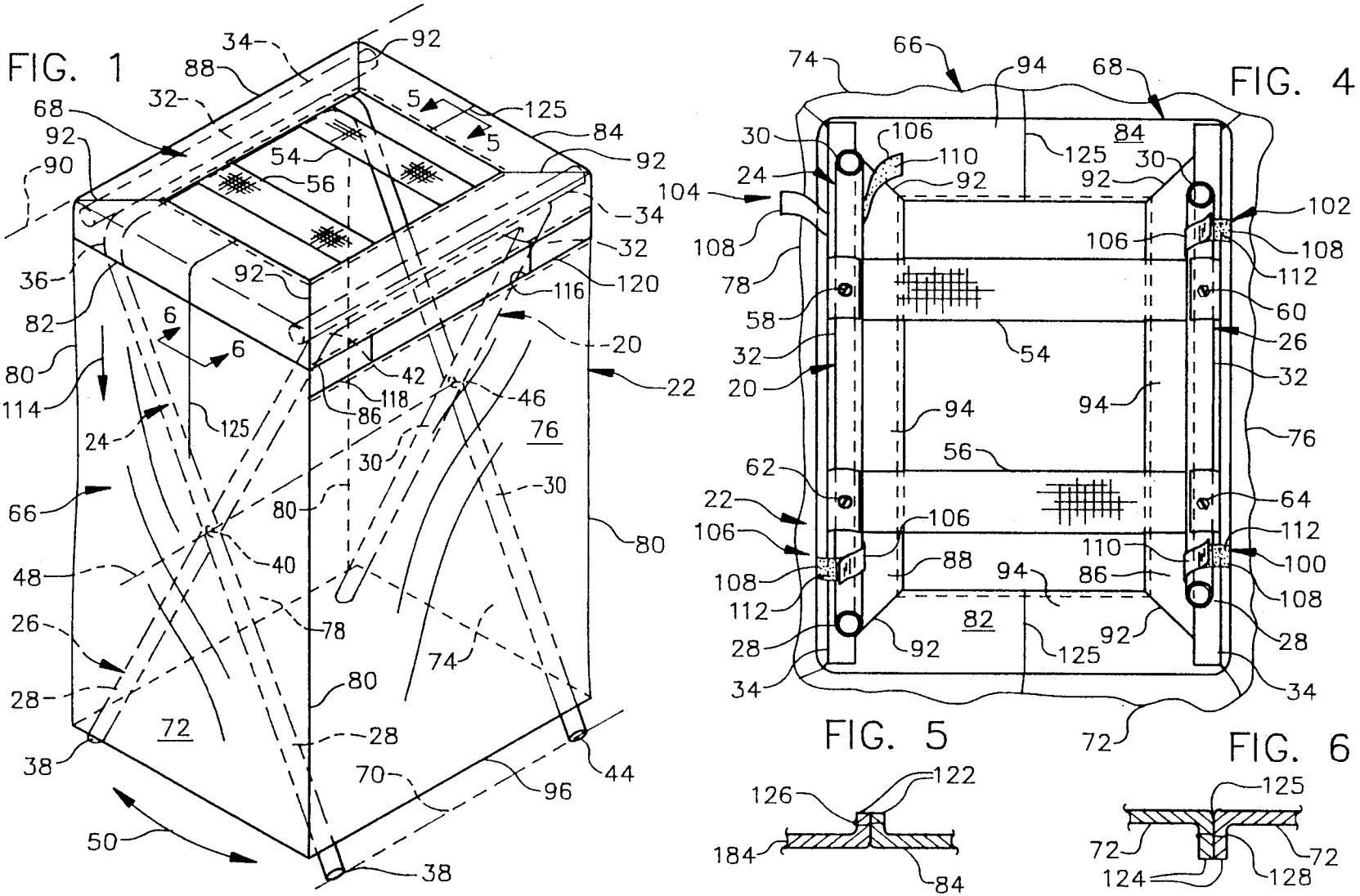
FIG. 1 is a pictorial view of a service tray jack enveloped by a cover embodying the principles of the present invention.
FIG. 4 is a section through the tray jack/cover assembly taken essentially along line 4—4 of FIG. 2.
FIG. 5 is a section through the cover, taken substantially along line 5—5 of FIG. 1.
FIG. 6 is a section through the cover, taken substantially line 6—6 of FIG. 1.
Figure 3:
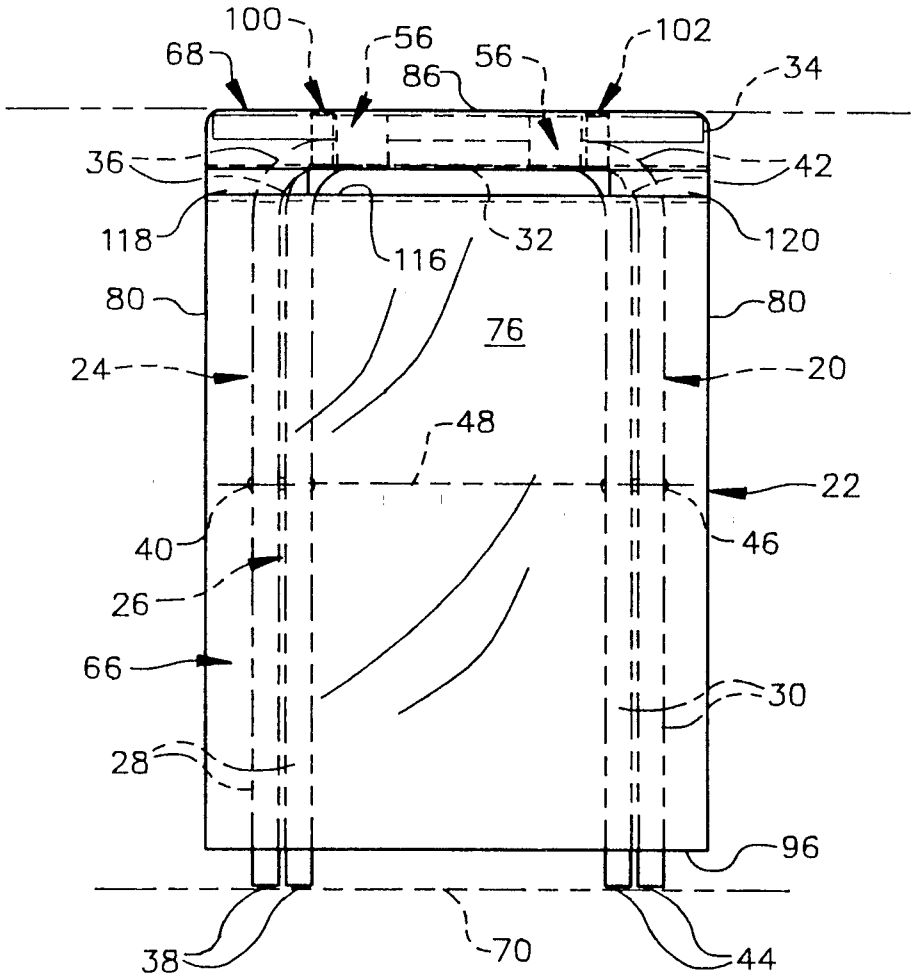
FIG. 3 is a side view of the tray jack and cover.
Figure 2:
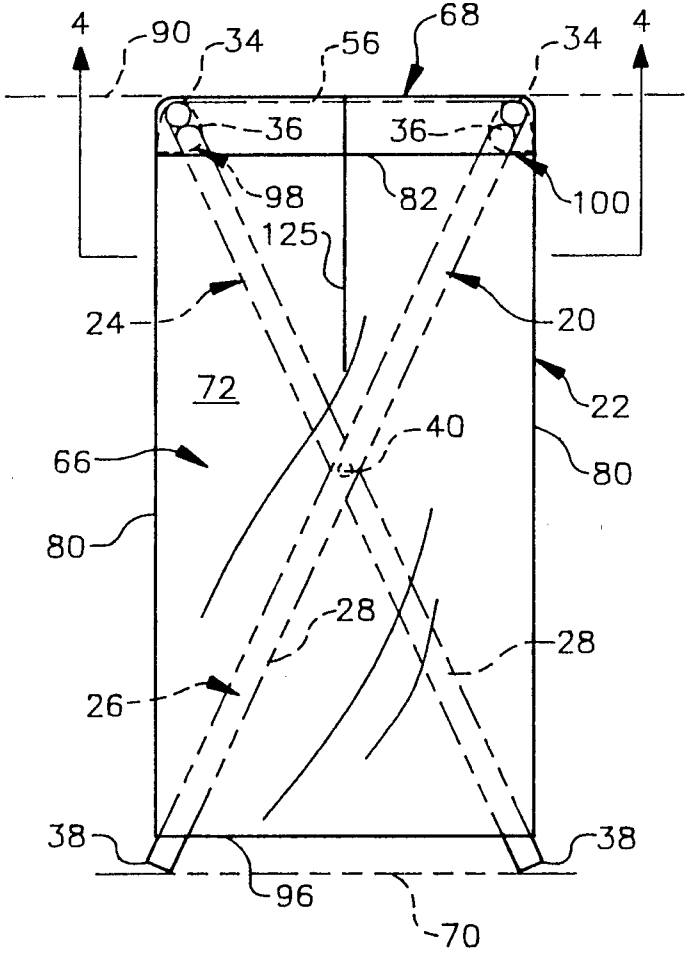
FIG. 2 an end view of the tray jack and cover.

Referring now to the drawing, FIGS. 1–4 depict a tray jack 20 equipped with a cover 22 which is designed to hide the tray jack in the interest of providing a serving or busing station with an attractive appearance, even if a relatively unattractive tray jack is employed.

Tray jack 20 is of conventional construction. It includes two U-shaped subassemblies 24 and 26, each having a pair of parallel, spaced apart, vertically extending legs 28 and 30. These legs are topped by an integral, horizontal leg 32. An also horizontally extending crosspiece 34 spans, and is fixed to, each of the subassembly horizontal legs or sections 32. Crosspieces 34 support a food service tray, busing container, or the like (not shown) when tray jack 20 is opened to the operating position shown in FIGS. 1–4.

Approximately midway between their upper and lower ends (or feet) 36 and 38, the two legs 28 of tray jack 20 are fixed together at one end of the tray by a screw, rivet or other pivot member 40. The two jack legs 30 are similarly fixed together intermediate their upper ends 42 and feet 44 at the opposite end of the jack by a pivot member 46. Pivot members 40 and 46 are aligned along the same pivot axis 48.

Figures 7, 8, 9:
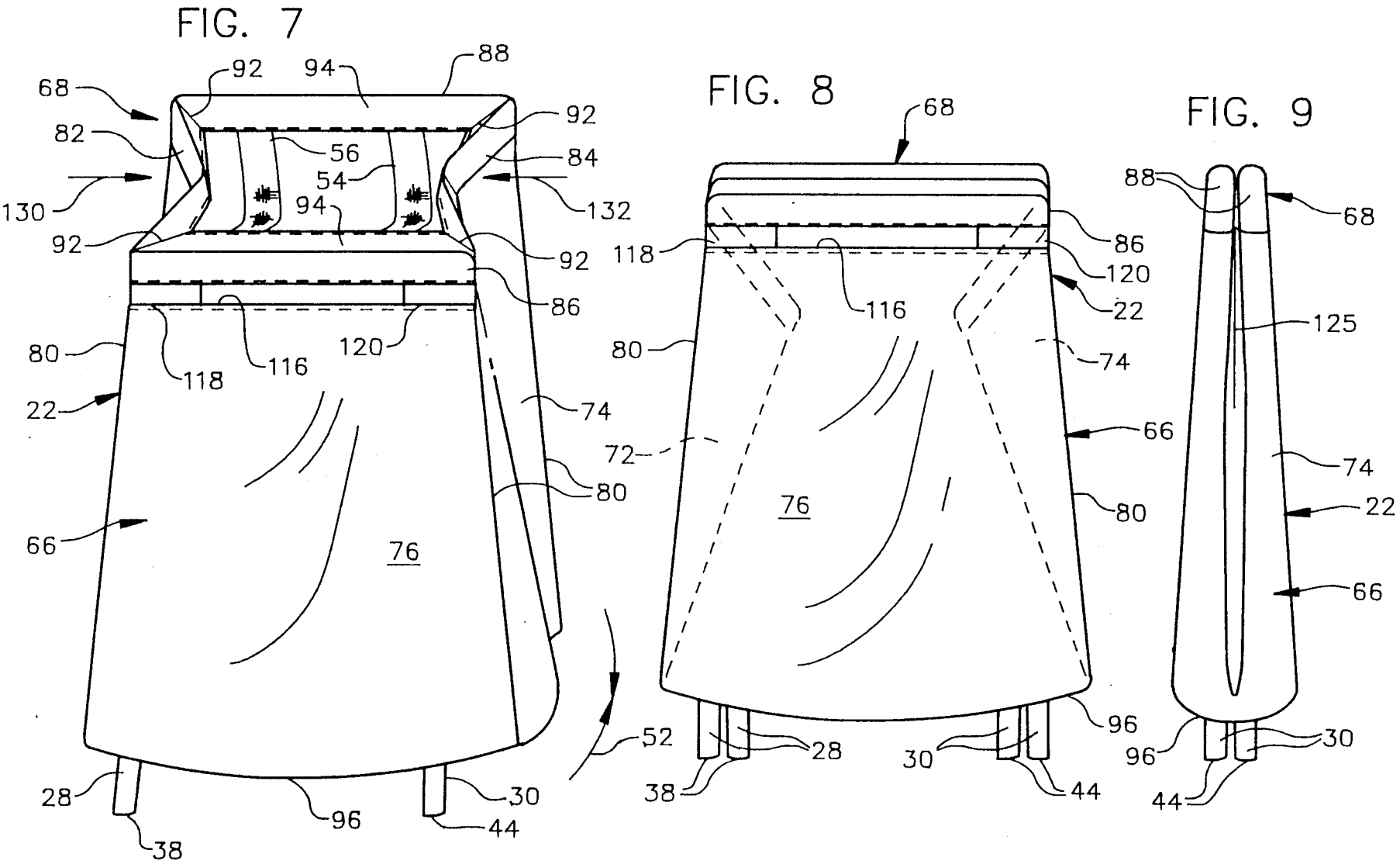
FIG. 7 is an end view of the assembly with the tray jack partially collapsed toward the folded configuration in which it is stored and transported from one location to another.
FIG. 8 is a side view of the assembly with the tray jack completely collapsed for transport or storage.
FIG. 9 is an end view of the collapsed tray and cover.

The arrangement just described allows tray jack subassemblies 24 and 26 to be swung apart as suggested by arrow 50 in FIG. I to place tray jack 20 in the operational configuration shown in that figure and to be swung together as indicated by arrow 52 in FIG. 7 to the collapsed, storing and transporting configuration depicted in FIGS. 8 and 9. In the operational configuration of tray jack 20 shown in FIG. 1, the relative movement of tray jack subassemblies 24 and 26 away from each other is limited to keep the jack in the illustrated, operational configuration by flexible straps 54 and 56. At one end (see FIG. 4) straps 54 and 56 are trained around and attached as by the illustrated screws 58 and 60 to the horizontal section 32 of tray jack subassembly 24. The opposite ends of straps 54 and 56 are similarly trained around and attached with screws 62 and 64 to the upper, horizontal member 32 of tray jack subassembly 26. Thus, with straps 54 and 56 fully extended as shown in FIGS. 1 and 4, the top sections 32 of subassemblies 24 and 26 cannot move further apart than is shown in those figures.

The illustrated tray jack is constructed of light weight metal tubing as is a second, commercially available jack which has a different scheme that keeps the two sub-assemblies of that jack from spreading too far apart. The third, commercially available tray jack is similarly constructed but of turned wooden dowels rather than metal tubing.

Referring still to FIGS. 1–4, the novel cover 22 employed to conceal tray jack 20 has: (a) a skirt 66 which surrounds and conceals the legs 28 and 30 of tray jack 20, and (b) what will herein be referred to as a top member or component 68. That component conceals the upper part of tray jack 20. Also, it is engaged by tray jack crosspieces 34, thereby supporting cover 22 in the proper relationship to the floor 70 on which tray jack 20 is placed.

The skirt 66 of tray jack cover 22 has end panels 72 and 74 and side panels 76 and 78. Vertical seams at the four corners 80 of skirt 66 join the end and side panels 72 . . . 78 together at the four corners 80 of the skirt, giving it the boxlike, jack concealing shape shown in FIG. 1.

The second, top component 68 of cover 22 is made up of trapezoidally configured, but longer, end panels 82 and 84 and similarly configured side panels 86 and 88. These panels are stitched or otherwise fixed to the correspondinq end and side panels 72 . . . 78 of skirt 66 at the upper end of the latter. Also, the panels of jack cover top member 68 are folded over to a horizontal orientation at the level indicated by reference character 90 in FIG. 1 and then stitched together along the diagonal lines identified in FIG. 1 by reference character 92.

The thus formed horizontally extending sections 94 of upper component panels 82 . . . 88 cover the crosspieces 34 of tray jack 20 and the upper ends of tray jack assemblies 24 and 26. They also rest on tray jack crosspieces 34, supporting the skirt 66 of the cover in surrounding, concealing relationship to tray jack subassemblies 24 and 26 with the bottom edge 96 of the skirt above floor 70.

It was pointed out above that decided benefits are obtained by positively securing cover 22 to tray jack 20 rather than simply draping a cloth over the jack as has heretofore been done. Cover 22 is provided with four fastener assemblies 98 . . . 104 for this purpose as is best shown in FIG. 4. Each of these fastener assemblies includes two straps 106 and 108. The straps are fixed, at one end, to the bottom side of a top component side panel 86 or 88. These fastener assemblies are located at the ends of the side panels 86 and 88 of tray jack cover upper component 68.

The inner side 110 and outer side 112 of cooperating straps 106 and 108 are faced with filamentary-type, hook-and-eye fastener material such as that identified by the trademark Velcro. Once cover 20 has been installed on tray jack 22 by sliding it down over the jack as suggested by arrow 114 in FIG. 1, the two straps 106 and 108 of each fastener 98 . . . 104 are trained around the associated tray jack crosspiece 34 and subassembly upper section 32. They are then fastened together as shown in FIG. 4 to positively affix cover 22 to tray jack 20.

To facilitate the just-described manipulation of fastener straps 106 and 108, and to also facilitate the opening and collapsing of tray jack 20, laterally extending, elongated, strap and tray jack accessing slots or openings are provided immediately below the side panels 86 and 88 of cover top component 68. One of these slots is illustrated in FIG. 1 and identified by reference character 1 16 Slots 116 are provided by making the skirt side panels 76 and 78 shorter than end panels 72 and 74. The ends of slots 116 are blocked in by the pieces of fabric identified by reference characters 118 and 120 in FIG. 1. These pieces of fabric are stitched to the side panels 76 and 78 of the skirt and to the corresponding panels 86 and 88 of the top cover component 68. At the extremities of slots 116, the marginal portions of fabric inserts 118 and 120 and the upper marginal portions of skirt side panels 76 and 78 are turned back and stitched down for added strength.

It was pointed out above that another novel feature of the tray jack covers disclosed herein is one which causes the upper end parts of the cover to automatically fold inward and together as tray jack 20 is collapsed from the operating configuration shown in FIG. 1 through the configuration shown in FIG. 7 to the fully collapsed configuration shown in FIGS. 8 and 9. In the illustrated, exemplary, tray jack cover 22 shown in the drawings, this important goal is realized by severing the end panels 82 and 84 of upper cover component 68 midway between their ends and continuing to cut downwardly through the upper reaches of the skirt's end panels 72 and 74, forming a slit 125. The marginal portions 122 and 124 of top component end panels 82 and 84 and of skirt end panels 72 and 74 adjacent these slits are then: (a) turned inwardly as shown in FIGS. 5 and 6 respectively, and (b) subsequently stitched together. Exemplary lines of stitching are identified by reference characters 126 and 128 in FIGS. 5 and 6 respectively.

As is apparent from viewing first FIG. 1, then FIG. 7, and finally FIG. 8, the just-described technique of: (a) cutting and then rejoining tray jack cover end panels 72, 74 and 82, 84; (b) turning in the marginal portions of the panels adjacent the cuts; and (c) stitching those portions together results in the wanted, automatic, inward collapse of those end panels (see arrows 130 and 132 in FIG. 7) as tray jack 20 is folded up.

As suggested above, cover 22 can be fabricated from a wide variety of materials, for example, one matching tablecloths, napkins, and other linen employed in the same setting. Or, if wanted, the name or logo of the establishment, a fun or theme design, etc. can be employed.

The invention may be embodied in forms other than that disclosed above without departing from the spirit or essential characteristics of the invention. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. The combination of a folding tray jack and a cover for said jack:

said tray jack having: two rigid, U-shaped components, each with a horizontally extending, tray and tray cover supporting leg at an upper end and two rigid inextensible spaced apart legs which depend from the horizontal leg and provide two laterally spaced, supporting engageable feet at the lower end of the jack; means so connecting said U-shaped components for relative pivotal movement about a transverse axis paralleling the axes of elongation of said horizontally extending legs at a level intermediate the upper and lower ends of said components that those ends can be swung toward each other to collapse the jack to a compact, easily handled configuration and away from each other to spread said ends and provide a second configuration in which said upper component ends are spread into a tray supporting role; and flexible strap means extending from one to the other of the tray components at the upper ends of said components for limiting the movement away from each other of the horizontally extending, tray and cover supporting legs as the upper component ends are spread apart into said tray supporting role; and said cover having: a skirt configured to surround said jack and extend from the upper ends of said components downwardly thereover, side and end panels at the upper end of the skirt which extend over the upper ends of said components and inwardly from the sides and ends of the jack toward but not to the center thereof, means for providing access through that part of the cover defined by said side and side panels, and a means for detachably securing said cover to said tray jack components at the upper ends thereof and thereby facilitating the user and handling of the covered tray jack.

2. A combination as defined in claim 1 in which the horizontal legs of the tray jack components are laterally extending members at the upper ends of said components and the means for securing said cover to said tray jack components comprises: flexible straps which are attached at a first end to the bottom of each of the cover side panels and are so spaced and dimensioned as to be trainable around the laterally extending members supporting said side panels and fastener means on those second ends of the straps trained around the laterally extending members of the tray jacks for securing the second strap ends to the first straps ends and thereby securing said cover side panels to said laterally extending tray jack members.

3. The combination of a folding tray jack and a cover for said jack:

said tray jack having: two components, each with an upper end and two laterally spaced feet at its lower end, and means so connecting said components for relative pivotal movement about a transverse axis at a level intermediate the upper and lower ends of said components the those ends can be swung toward each other to collapse the jack into a compact, easily handled configuration from each other to spread said ends and provide a second configuration in which said feet are in a jack stabilizing relationship and said upper component ends are spread into a tray supporting role; and said cover having: a skirt configured to surround said jack and extend from the upper ends of said components downwardly thereover, panels at the upper end of the skirt which extend over the upper ends of said components and inwardly from the sides and ends of the jack, inner edges spaced from the center of the cover, and means for causing the ends of said cover to automatically fold inwardly and together as said tray jack is collapsed to its first, collapsed configuration; the means for causing the ends of the cover to fold inwardly and together as the tray jack is collapsed comprising: (a) inwardly turned, marginal cover portions defined by a slit which is located between opposite edges of those panels at the upper ends of the cover and extends from its inner edge across each said panel and downwardly along said skirt; and (b) means joining said inwardly turned marginal portions together.

4. The combination as defined in claim 3 in which the cover has means for detachably securing said cover to said tray jack and thereby facilitating the use and handling of the covered jack;

said tray jack components having laterally extending tray and tray cover supporting members at said upper ends thereof; said cover having access means through and in the top thereof; and the means for securing said cover to said tray jack components being accessible through said access means and comprising: straps which are attached at a first end to the bottom of each cover side panel and are so dimensioned as to be trainable around one of said laterally extending members in overlapping relationship and fastener means on those second ends of the straps trained around the laterally extending members of the tray jacks for securing said second strap ends to the first strap ends.

5. A tray jack cover which has ends and sides defining a jack concealing skirt, a top part comprised of side panels and end panels with inner edges and means for folding the ends of the cover inwardly and together as the sides of the cover are displaced toward each other; the means for folding the ends of the cover inwardly and together as the sides of the cover are displaced toward each other comprising: (a) inwardly turned, marginal portions formed by a slit located between opposite edges of said end panels and extending across said end panels from the inner edges thereof and downwardly along the ends of said skirt; and (b) means joining said marginal portions together.

6. A cover as defined in claim 5 which has fastener means for detachably securing said cover to a tray jack and thereby facilitating the use and handling of the covered jack and access means through which the fastener means can be reached after the cover has been installed on the tray jack, said fastener means comprising: (a) first and second, elongated straps which are accessible through said access means, attached at one end to the bottom of the cover at the sides thereof and trainable around tray jack components to secure the cover to said components, and (b) means on second, exposed ends of the straps for securing those ends to the first strap ends.

* * * * *

UNITED STATES PATENT AND TRADEMARK OFFICE

CERTIFICATE OF CORRECTION

PATENT NO. : 5,165,633

DATED : 24 November 1992

INVENTOR(S) : Gerald I. Effa

It is certified that error appears in the above-identified patent and that said Letters Patent is hereby corrected as shown below:

Title page:
Abstract, line 4, "lags" should be --legs--.

Column 4, line 50, "1 16" should be --116--.

Column 5, line 45, "supporting engageable" should be --supporting surface engageable--.

Column 6, line 2, "side and side" should be --side and end--.

Column 6, line 5, "user" should be --use--.

Column 6, line 28, "the" should be --that--.

Column 6, line 30, "configuration from" should be --configuration and away from--.

UNITED STATES PATENT AND TRADEMARK OFFICE

CERTIFICATE OF CORRECTION

PATENT NO. : 5,165,633

DATED : 24 November 1992

INVENTOR(S) : Gerald I. Effa

It is certified that error appears in the above-indentified patent and that said Letters Patent is hereby corrected as shown below:

Column 6, line 53, "The" should be --A--.

Signed and Sealed this

Fifteenth Day of February, 1994

Bruce Lehman

*Attest:*

BRUCE LEHMAN

*Attesting Officer*

*Commissioner of Patents and Trademarks*